United States Patent [19]

Weber

[11] 4,269,530

[45] May 26, 1981

[54] DOCUMENT RETAINING SYSTEM

[76] Inventor: Joseph Weber, 1105 Massachusetts Ave., Cambridge, Mass. 02138

[21] Appl. No.: 86,940

[22] Filed: Oct. 22, 1979

[51] Int. Cl.[3] ..... B42F 13/10

[52] U.S. Cl. ..... 402/15; 402/72; 402/80 R; 402/74

[58] Field of Search ..... 402/8, 15, 16, 17, 80 R, 402/4, 73, 74, 75, 70, 72, 80 P, 146; 281/29, 31

[56] References Cited

U.S. PATENT DOCUMENTS

| | | | |
|---|---|---|---|
| 3,073,315 | 1/1963 | Schade . | |
| 3,635,568 | 1/1972 | Dalferes | 402/17 |
| 3,830,574 | 8/1974 | Strong | 402/14 |
| 3,994,606 | 11/1976 | Messmer | 402/17 |
| 4,084,911 | 4/1978 | DeWitt | 402/15 |
| 4,135,832 | 1/1979 | Saltz | 402/15 |

FOREIGN PATENT DOCUMENTS

| | | | |
|---|---|---|---|
| 1229498 | 12/1966 | Fed. Rep. of Germany | 402/8 |

*Primary Examiner*—Paul A. Bell
*Assistant Examiner*—John S. Brown

[57] ABSTRACT

A folder and fastener for retaining perforated sheets are provided with a fastener travel limiter secured on the inner surface of the upper flap of the folder. The fastener comprises a flexible tubular member attached to the inner surface of the lower flap of the folder and providing two ends extending through the sheet perforations, and a stiff closure element having ends releasably engaging the flexible member ends. The travel limiter engages the closure element and defines a travel space for it, permitting free travel of the closure element parallel with the upper flap inner surface during opening and closing of the folder.

9 Claims, 6 Drawing Figures

FIG 1
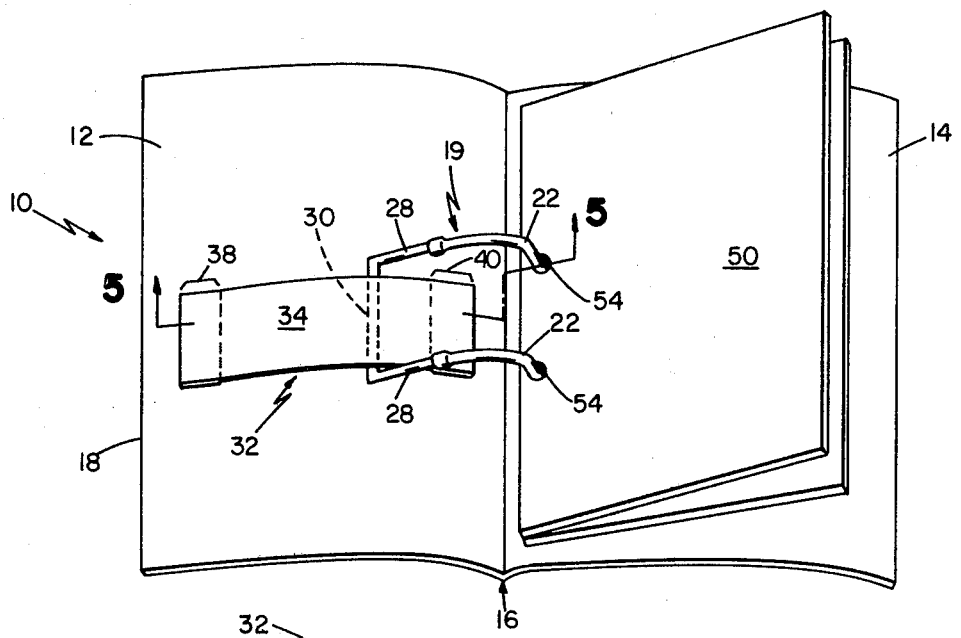
FIG 2
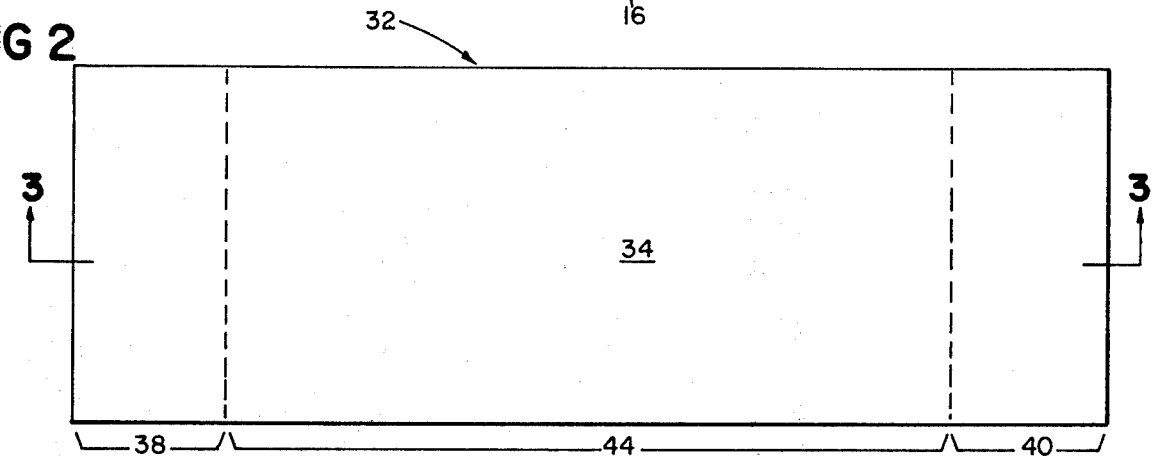
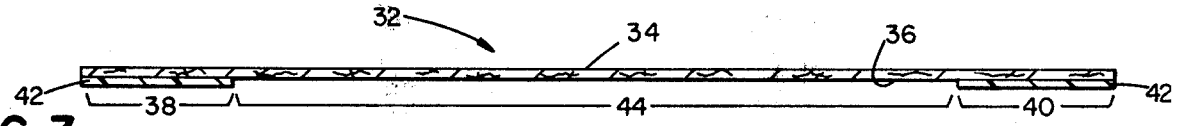
FIG 3
FIG 4
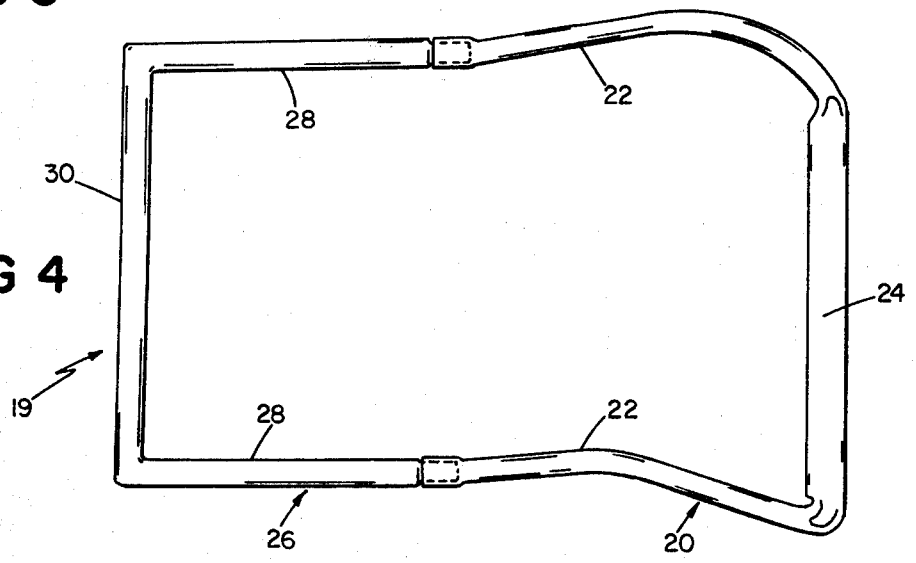

FIG 8
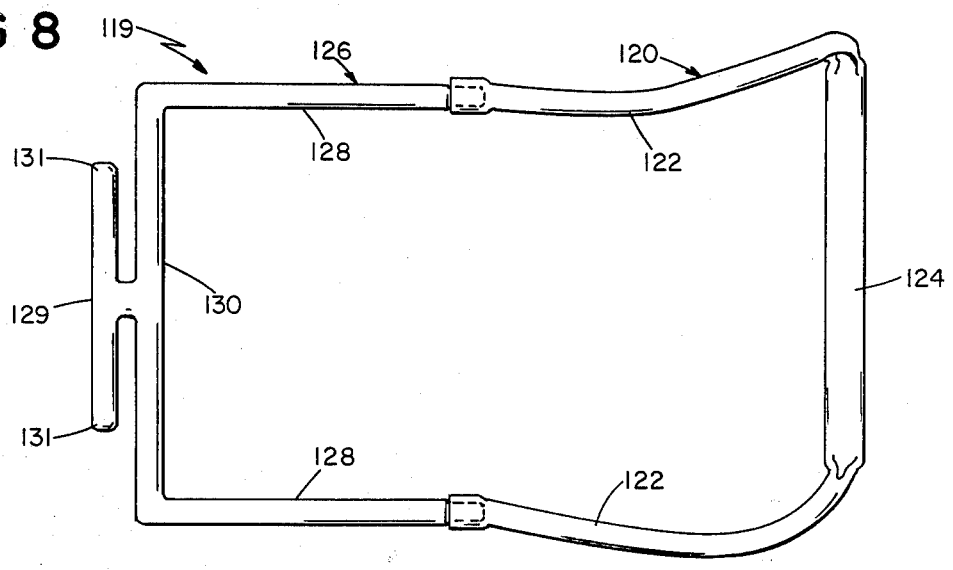
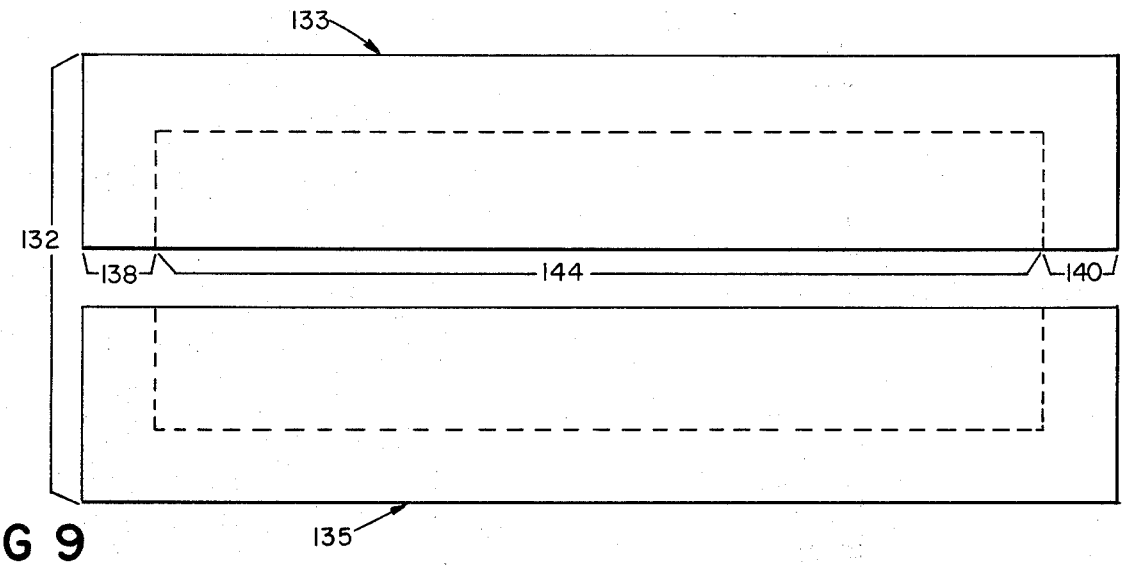
FIG 9
FIG 10
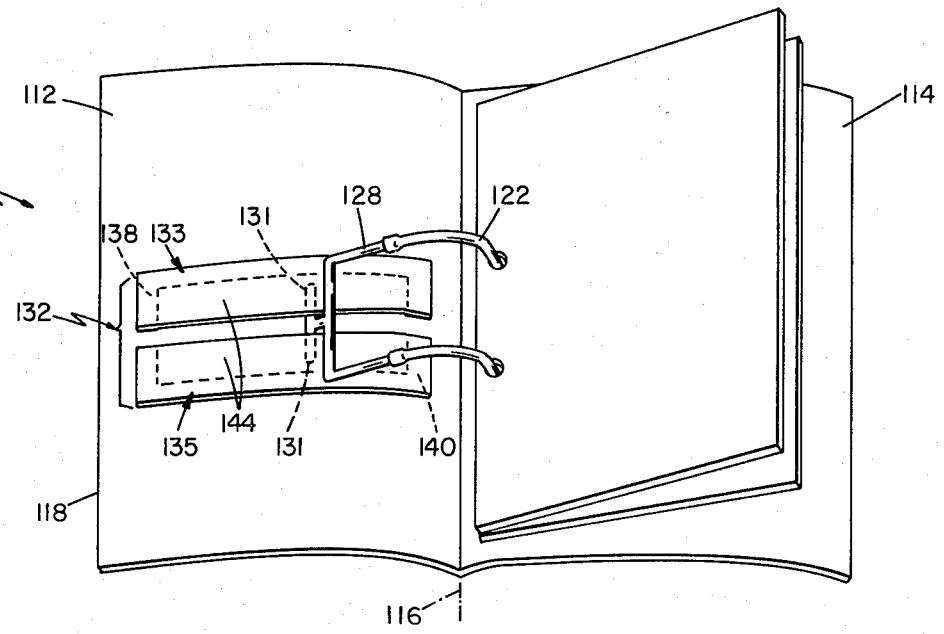

DOCUMENT RETAINING SYSTEM

This invention relates to flexible fasteners for securing perforated sheets of paper within folders, and to a document retaining system employing such a fastener.

A fastener comprising an elongated flexible thermoplastic tubular member having opposite ends arranged to extend through spaced apart perforations in paper sheets, and a stiff generally U-shaped bridge member or closure member whose spaced apart ends are releasably engaged by the ends of the tubular member, is described, for example, in U.S. Pat. No. 4,084,911. In the cited patent, a stiff keeper is provided, having a pair of frictional locks for engaging portions of the flexible tubular member just above the top sheet of perforated paper to retain the filed sheets in position against the folder.

Such fasteners, and folders provided with such fasteners, provide advantages. The folder, unlike a ring binder (loose-leaf binder), has no fixed spine, and can expand or compress to accommodate the thickness of the papers in the folder at any time, taking up no more file space than is required by them. Further, unlike flexible flat metal prong fasteners, the flexible tubular fastener including the bridge permits papers to be inserted anywhere in the filed record without having to remove the upper portion of the record from the fastener; such removal from the metal prong fastener leaves the removed papers loose, and liable to get out of proper order; further, the perforations frequently become misalligned. Moreover, the flexible fastener, being tubular, does not cut the paper sheets filed in the folder as the flat metal prong fastener frequently does.

However, the system described in the cited patent has certain disadvantages. In the system employing a stiff keeper, the filed pages are held in place against the bottom flap of the folder until both fastener ends are released from the keeper. Unlike pages in a ring binder, the pages cannot be freely turned, the back side of a page cannot be easily written on, the left margins of the pages are obscured. Pages cannot be inserted or removed until the keeper has been released; pages cannot be photocopied without removing the keeper.

It is an object of the present invention to eliminate these disadvantages, and to provide a fastener and a document retaining system which allow immediate access to all portions, front and back, of each of the filed pages, and which permit the filed pages to be freely turned and to be photocopied. It is a further object of the present invention to provide a simple and convenient document retaining system having the advantages both of a loose leaf ring binder and of a flexible tubular fastener system, without the disadvantages described above.

The invention provides a document retaining system comprising a folder having upper and lower flaps hingedly joined along one edge of each flap for movement of their inner faces toward and away from each other when the folder is closed and opened each flap having a free edge opposing its joined edge, and paper securing means for securing perforated sheets of paper within the folder. The paper securing means comprises at least one elongated flexible member arranged to extend through the perforations and having adjacent one end a base portion constructed and arranged for attachment to the inner face of the lower flap adjacent said joined edge. The paper securing means further comprises means for releasably connecting the other end of the flexible member to the upper flap. The connecting means includes means for permitting movement of the connection of the end in response to opening or closing of said folder between a position adjacent said free edge of said upper flap when said folder is closed and a position adjacent said joined edge when said folder is open.

In preferred embodiments, the invention provides a fastener travel limiter for use in a document retaining system for securing perforated sheets of paper, comprising a folder, a fastener for securing perforated sheets of paper within the folder, and a closure member. The folder has upper and lower flaps hingedly joined along one edge of each flap, each flap having a free edge opposed to the joined edge. The fastener comprises an elongated flexible member arranged to extend through a perforation in a sheet and a base portion adjacent one end for attachment to the folder lower flap inner surface adjacent to the joined edge. A stiff closure member is arranged to engage releasably with the free end of the flexible member.

The fastener travel limiter is made of flexible tear-resistant sheet material, having upper and lower surfaces, and comprises at least two attachment portions providing adhesive on their lower surfaces, and a closure member engaging portion. The fastener travel limiter is sized and adapted for being secured at its attachment portions with its lower surface adjacent the inner surface of the folder upper flap, with the closure member engaged between the folder upper flap and the closure member engaging portion. The overall length of the limiter is adapted to permit the limiter to be secured between the upper flap joined edge and the upper flap free edge. The closure member engaging portion is adapted to cooperate with the upper flap inner surface to define a closure member travel space adjacent the upper flap inner surface, extending from adjacent the upper flap joined edge to adjacent the upper flap free edge; the length of the closure member engaging portion is adapted to define such a closure member travel space permitting free travel of the closure member parallel with the upper flap inner surface during opening and closing of the folder.

In a particularly preferred embodiment, the fastener comprises an elongated flexible member having opposite end portions arranged to extend through spaced apart perforations in the sheets and an intermediate base portion for attachment to the folder lower flap inner surface parallel with and adjacent to the joined edge. The closure member comprises a stiff generally U-shaped bridge member having two ends joined by a transverse element; the transverse element has a length approximately equal to the length of the intermediate base portion of the tubular member, and its ends are arranged to engage releasably with opposite ends of the tubular member to maintain them spaced apart. The fastener travel limiter comprises a plane strip of flexible tear-resistant material, having upper and lower surfaces. The strip comprises two end portions each providing adhesive on the lower surface thereof, and an intermediate portion extending lengthwise between the end portions and having a width less than the distance between the bridge ends.

The strip is sized and adapted for being secured at its end portions with its lower surface adjacent the inner surface of the folder upper flap, with the bridge transverse element engaged between the folder upper flap and the intermediate portion. The overall length of the strip is adapted to permit a first end portion to be secured adjacent the upper flap joined edge and the second end portion to be secured adjacent the upper flap free edge.

The strip intermediate portion is adapted to cooperate with the upper flap inner surface to define a bridge travel space adjacent the upper flap inner surface, extending from the first strip end portion to the second strip end portion; the length of the intermediate portion is adapted to define such a bridge travel space permitting free travel of the bridge transverse element parallel with the upper flap inner surface during rotation of the upper flap with respect to the lower flap through an angle of about 180 degrees.

Other objects, features and advantages will appear from the following description of a preferred embodiment, together with the drawing, in which:

FIG. 1 is an isometric view of an open file folder having a fastener and travel limiter mounted in place and holding a number of perforated paper sheets;

FIG. 2 is a plan view of the travel limiter;

FIG. 3 is a cross section taken on line 3—3 of FIG. 2;

FIG. 4 is a plan view of the fastener;

FIG. 8 shows an alternative embodiment of a fastener;

FIG. 9 shows an alternative embodiment of a fastener travel limiter for use with the fastener of FIG. 8; and FIG. 10 shows the elements of FIGS. 8 and 9 assembled in a folder.

Figure 5:
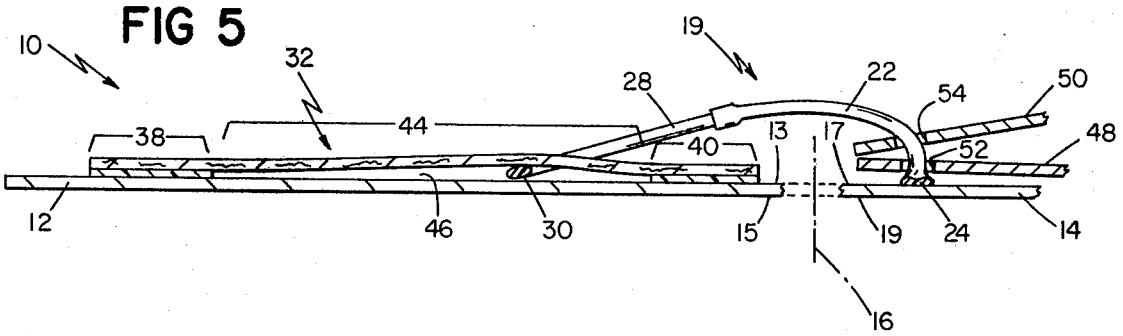
FIG. 5 is a cross section taken on line 5—5 of FIG. 1.

Referring now to the drawing, and in particular to FIG. 1, a document retaining system comprises a folder 10, fastener 19 and travel limiter 32. File folder 10 comprises an upper flap 12 and a lower flap 14. Referring to FIG. 5, upper flap 12 has an inner surface 13 and an outer surface 15; lower flap 14 has an inner surface 17 and an outer surface 19. Only the inner surfaces are visible in FIG. 1. Flaps 12 and 14 are hingedly joined along one edge of each, by means not material to the present invention. In the embodiment shown in the drawing, the upper and lower flaps are joined at a fold line 16, but any other suitable join may be used. (Because of the necessity to exaggerate the thickness of the elements in the drawing, the fold region has been omitted from FIGS. 5, 6 and 7.) Flap 12 has a free edge 18 opposed to the joined edge.

Referring now particularly to FIG. 4, a fastener 19 comprises an elongated flexible member 20 having opposite end portions 22 arranged to extend through spaced apart perforations in the sheets to be filed, and an intermediate base portion 24 for attachment to the folder lower flap inner surface 17 parallel with and adjacent to the joined edge 16 thereof. The means of attachment form no part of the present invention; suitable means are disclosed in the cited U.S. Pat. No. 4,084,911, incorporated herein by reference.

The fastener further comprises a stiff generally U-shaped bridge member or closure member 26 having two ends 28 joined together by a transverse element 30 having a length approximately equal to the length of the intermediate portion 24 of the flexible member. Ends 28 are arranged to engage releasably with opposite ends 22 of flexible member 20 to maintain them spaced apart.

Referring now to FIGS. 2 and 3, a fastener travel limiter comprises a plane strip 32 of flexible, tear-resistant material, having upper and lower surfaces 34 and 36. Strip 32 comprises two end portions (attachment portions) 38 and 40, each providing adhesive 42 on the lower surface thereof. Strip 32 further comprises an intermediate portion 44 extending lengthwise between the end portions 38 and 40, and having a width less than the distance between bridge ends 28. In preferred embodiments, the width of intermediate portion 44 is only slightly less than the distance between bridge ends 44.

Strip 32 is sized and adapted to be secured by its end portions 38 and 40 to upper flap 12, with strip lower surface 36 adjacent inner surface 13 of upper flap 12, and with bridge transverse element 30 engaged between upper flap 12 and strip intermediate portion 44. The overall length of strip 32 is adapted to permit first end portion 40 to be secured adjacent joined edge or fold line 16 of upper flap 12, and second end portion 38 to be secured adjacent the free edge 18 of upper flap 12.

Strip intermediate portion 44 is adapted to cooperate with the inner surface of upper flap 12 to define a bridge travel space adjacent the inner surface of upper flap 12, extending from first end portion 40 to second end portion 38. The length of intermediate portion 44 is adapted to define such a bridge travel space which will permit free travel of bridge transverse element 30 parallel with the inner surface 13 of upper flap 12 during rotation of upper flap 12 with respect to lower flap 14 through an angle of about 180 degrees.

To assemble the document retaining system of the invention, base portion 24 of flexible member 20 of fastener 19 is assembled to inner surface 17 of lower flap 14, preferably by the means disclosed in U.S. Pat. No. 4,084,911, cited above. Bridge member 26 is assembled to flexible member 20 by engaging ends 28 in ends 22. Strip 32 is then placed over transverse element 30 of bridge member 26 and against the inner surface of upper flap 12, with first end portion 40 adjacent fold line 16 and second end portion 38 adjacent free edge 18. Bridge member 26 is thus engaged by strip 32. End portions 38 and 40 are then assembled to inner surface 13 of upper flap 12 by means of adhesive 42. Alternatively, before engaging bridge member 26 with flexible member 20, strip 32 may be placed over transverse element 30 of bridge member 26 and against inner surface 13 of upper flap 12, as described, and assembled thereto, after which bridge member 26 may be assembled to tubular member 20.

Figure 6:
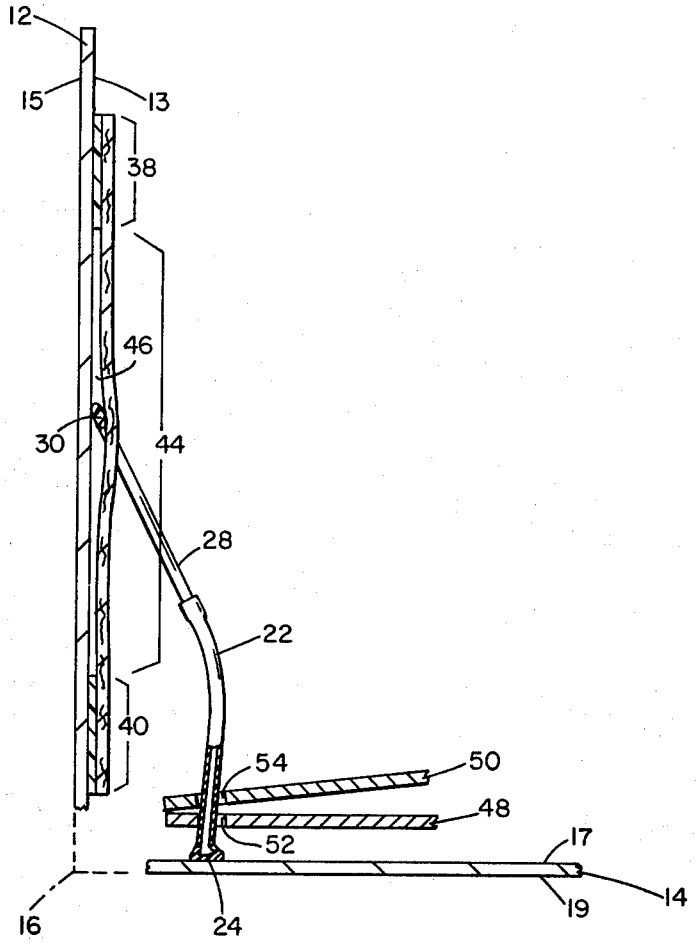
FIG. 6 is similar to FIG. 5 (with the fold portion removed) but shows the upper flap rotated through 90 degrees with respect to the lower flap.
Figure 7:
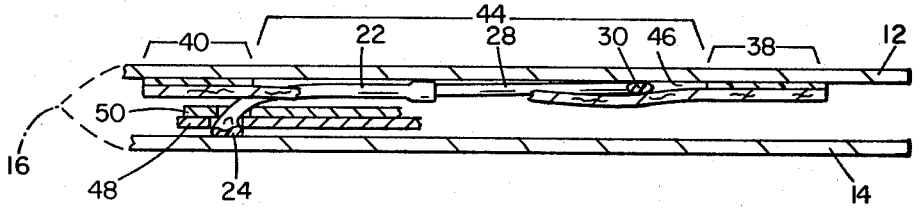
FIG. 7 is similar to FIG. 6 but shows the upper flap rotated through 180 degrees with respect to the lower flap.

Referring now to FIGS. 5, 6 and 7, a portion of the assembled structure is seen. Strip intermediate portion 44 cooperates with inner surface 13 of upper flap 12 to define a bridge travel space 46, extending from first end portion 40 to second end portion 38.

To insert sheets into the document retaining system, folder 10 is opened, and flexible member ends 22 are disengaged from bridge member ends 28. Sheets such as 48 and 50 are then placed in folder 10, ends 22 extending through perforations 52 and 54 of the sheets. Bridge member 26 is retained by strip 32 during this operation. Ends 22 are then reengaged in ends 28. The resulting configuration is seen in FIG. 5.

As the folder is closed, it passes through the intermediate position seen in FIG. 6; bridge transverse element 30 slides freely parallel to inner surface 13 of upper flap 12, being engaged by intermediate portion 44 of strip 32.

In preferred embodiments, in the closed position of the folder, as seen in FIG. 7, bridge transverse element 30 is at the end of travel space 46 adjacent strip end portion 38, but does not reach end portion 38. Therefore, no force is exerted on end portion 38 by transverse element 30 tending to release the adhered surface of end portion 38. Thus, the bridge travel space 46 defined by strip 32 in cooperation with upper flap 12 permits free travel of bridge transverse element 30 parallel with the inner surface 13 of upper flap 12 during opening and closing of the folder.

Further, in preferred embodiments, travel space 46 is long enough to permit the folder to be opened through an angle greater than 180 degrees, without permitting bridge transverse element 30 to reach end portion 40. This ensures that no force is exerted on end portion 40 by transverse element 30 tending to release the adhered surface of end portion 40.

An alternative embodiment is seen in FIGS. 8, 9 and 10. In this embodiment, fastener 119 comprises a flexible member 120, similar to flexible member 20 of the first embodiment, having a base portion 124 and ends 122. A closure member or bridge member 126 provides ends 128 and a transverse element 130. Bridge member 126 need not be at right angles to end 128, but could have, for example, a 4-shaped configuration. Transverse element 130 maintains fastener ends 122 spaced apart. Bridge member 126 further provides a tracking element 129, carried on transverse element 130 on the side away from ends 128. Tracking element 129 has two fingers 131.

Fastener travel limiter 132 comprises two strip portions 133 and 135. Each strip portion provides an attachment portion 138 around three marginal areas thereof, the fourth marginal area 144 being free of adhesive.

This embodiment of the invention is assembled as seen in FIG. 10; the two strip portions 133 and 135 are attached in parallel arrangement, slightly spaced apart, to the inner surface of upper flap 112. The adhesive-free portions 144 of the two strips are adjacent one another, and each finger 131 of tracking element 129 is engaged between an adhesive-free portion 144 of a strip and the inner surface of folder upper flap 112.

The two adhesive free portions 144 of strips 133 and 135 thus together comprise a closure member engaging portion of the travel limiter. The closure member engaging portion is adapted to cooperate with the upper flap inner surface to define a closure member travel space adjacent the upper flap inner surface, extending from adjacent the upper flap joined edge 116 to adjacent the upper flap free edge 118. The length of the closure member engaging portion is adapted to define a closure member travel space permitting free travel of closure member 126 parallel with the upper flap inner surface during rotation of upper flap 112 with respect to lower flap 114 through an angle of about 180 degrees.

Fastener 119 can be opened and closed as previously described to permit pages to be added to or removed from the folder 110.

In still another alternative embodiment, not shown in the drawing, the fastener comprises a flexible tubular member having an attachment portion and a single end portion arranged to extend through a perforation in a sheet of paper. The closure member likewise provides a single end arranged to engage releasably with the tubular member end. The closure member further provides a tracking element like element 129 shown in FIG. 8, and the travel limiter has the form shown in FIGS. 9 and 10.

In a still further alternative embodiment, also not shown in the drawing, a fastener of the form shown in FIG. 4 is employed; two parallel slits are provided in upper flap 12 of folder 10, extending between joined edge 16 and free edge 18 thereof, spaced apart by a distance equal to the spacing of closure member ends 28. Closure member 28 is engaged with flap 10, having its transverse element 30 adjacent the outer side 15 of flap 12, with its ends 28 extending through the slits and then engaged with ends 22 of flexible member 20. The slit defining portions of flap 12 together with closure member 26 of fastener 32 comprise means for releasably connecting ends 22 of flexible member 20 to upper flap 12.

The flexible member 120 of FIG. 8 can likewise be releasably connected to upper flap 112 by means comprising closure member 119 and flap portions defining a single slit.

What is claimed is:

1. A document retaining system for securing perforated sheets of paper comprising a folder having upper and lower flaps hingedly joined along one edge of each said flap, each said flap having a free edge opposing said joined edge, a fastener comprising an elongated flexible member having opposite end portions arranged to extend through spaced apart perforations in said sheets and an intermediate base portion for attachment to said lower flap inner surface parallel with and adjacent to said joined edge, and a stiff bridge member providing a generally U-shaped portion having two ends joined by a transverse element, said bridge member ends being arranged to engage releasably with opposite ends of said flexible member, said transverse element maintaining said flexible member end portions spaced apart, and a fastener travel limiter of flexible tear-resistant sheet material, having upper and lower surfaces, and comprising at least two attachment portions providing adhesive on said lower surface thereof, and a bridge member engaging portion extending lengthwise of said travel limiter, said travel limiter being sized and adapted for being secured at its said attachment portions with its said lower surface adjacent said inner surface of said folder upper flap, with said bridge member engaged between said folder upper flap and said bridge engaging portion, the overall length of said travel limiter being adapted to permit said travel limiter to be secured between said upper flap joined edge and said upper flap free edge, said bridge engaging portion being adapted to cooperate with said upper flap inner surface to define a bridge travel space adjacent said upper flap inner surface, extending from adjacent said upper flap joined edge to adjacent said upper flap free edge, the length of said bridge engaging portion being adapted to define a said bridge travel space permitting free travel of said bridge parallel with said upper flap inner surface during rotation of said upper flap with respect to said lower flap through an angle of about 180 degrees.

2. The document retaining system of claim 1 wherein said fastener travel limiter comprises a plane strip having two end attachment portions each providing adhesive on said lower surface thereof, and an intermediate bridge member engaging portion extending lengthwise between said end portions and having a width less than the distance between said bridge ends, the overall length of said strip being adapted to permit a first said end portion to be secured adjacent said upper flap joined edge and the second said end portion to be secured adjacent said upper flap free edge, said strip intermediate bridge engaging portion being adapted to cooperate with said upper flap inner surface to define a bridge travel space adjacent said upper flap inner surface, extending from said first end portion to said second end portion.

3. The document retaining system of claim 2, said width of said bridge member engaging portion being almost as great as said distance between said bridge ends.

4. The document retaining system of claim 2, the length of said intermediate bridge member engaging portion being adapted to define a said bridge travel space permitting free travel of said bridge transverse element parallel with said upper flap inner surface without engagement of said bridge transverse element with either of said strip end attachment portions at either end of a rotation of said upper flap with respect to said lower flap through an angle of about 200 degrees.

5. A document retaining system comprising a folder having upper and lower flaps hingedly joined along one edge of each flap, each flap having a free edge opposing said joined edge, a fastener for securing perforated sheets of paper within said folder, comprising an elongated flexible member having opposite end portions arranged to extend through spaced apart perforations in said sheets and an intermediate base portion for attachment to said lower flap inner surface parallel with and adjacent to said joined edge, and a stiff bridge member providing a generally U-shaped portion having two ends joined by a transverse element, said bridge member ends being arranged to engage releasably with opposite ends of said flexible member, said transverse element spaced apart, and a fastener travel limiter of flexible tear-resistant sheet material, having upper and lower surfaces, and comprising at least two attachment portions providing adhesive on said lower surface thereof, and a bridge member engaging portion extending lengthwise of said travel limiter, said travel limiter being sized and adapted for being secured at its said attachment portions with its lower surface adjacent said inner surface of said folder upper flap, with said bridge member engaged between said folder upper flap and said bridge engaging portion, the overall length of said travel limiter being adapted to permit said travel limiter to be secured between said upper flap joined edge and said upper flap free edge, said bridge engaging portion being adapted to cooperate with said upper flap inner surface to define a bridge travel space adjacent said upper flap inner surface, extending from adjacent said upper flap joined edge to adjacent said upper flap free edge, the length of said bridge engaging portion being adapted to define a said bridge travel space permitting free travel of said bridge parallel with said upper flap inner surface during rotation of said upper flap with respect to said lower flap through an angle of about 180 degrees.

6. The document retaining system of claim 5, said fastener travel limiter comprising a plane strip having two end attachment portions each providing adhesive on said lower surface thereof, and an intermediate bridge member engaging portion extending lengthwise between said end portions and having a width less than the distance between said bridge ends, the overall length of said strip being adapted to permit a first said end portion to be secured adjacent said upper flap joined edge and the second said end portion to be secured adjacent said upper flap free edge, said strip intermediate bridge engaging portion being adapted to cooperate with said upper flap inner surface to define a bridge travel space adjacent said upper flap inner surface, extending from said first end portion to said second end portion.

7. The document retaining system of claim 6, said width of said fastener travel limiter bridge member engaging portion being almost as great as said distance between said bridge ends.

8. The document retaining system of claim 6, the length of said intermediate bridge member engaging portion being adapted to define a said bridge travel space permitting free travel of said bridge transverse element parallel with said upper flap inner surface without engagement of said bridge transverse element with either of said strip end attachment portions at either end of a rotation of said upper flap with respect to said lower flap through an angle of about 200 degrees.

9. A document retaining system for securing perforated sheets of paper comprising a folder having upper and lower flaps hingedly joined along one edge of each flap, each flap having a free edge parallel with said joined edge, a fastener for securing perforated sheets of paper within said folder, comprising an elongated flexible member having opposite end portions arranged to extend through spaced apart perforations in said sheets and an intermediate base portion for attachment to said lower flap inner surface parallel with and adjacent to said joined edge, a stiff generally U-shaped bridge member having two ends joined by a transverse element, said transverse element having a length approximately equal to the length of said intermediate portion of said flexible member, said ends being arranged to engage releasably with opposite ends of said flexible member to maintain them spaced apart, and a fastener travel limiter comprising a plane strip of flexible tear-resistant material, having upper and lower surfaces, and comprising two end portions each providing adhesive on said lower surface thereof, and an intermediate portion extending lengthwise between said end portions and having a width less than the distance between said bridge ends, said strip being sized and adapted for being secured at its said end portions with its said lower surface adjacent said inner surface of said folder upper flap, with said bridge transverse element engaged between said folder upper flap and said intermediate portion, the overall length of said strip being adapted to permit a first said end portion to be secured adjacent said upper flap joined edge and the second said end portion to be secured adjacent said upper flap free edge, said strip intermediate portion being adapted to cooperate with said upper flap inner surface to define a bridge travel space adjacent said upper flap inner surface, extending from said first end portion to said second end portion, the length of said intermediate portion being adapted to define a said bridge travel space permitting free travel of said bridge transverse element parallel with said upper flap inner surface during rotation of said upper flap with respect to said lower flap through an angle of about 180 degrees.

* * * * *